US006538365B2

(12) United States Patent
Nasu et al.

(10) Patent No.: US 6,538,365 B2
(45) Date of Patent: Mar. 25, 2003

(54) METAL MEMBER WITH CHROMATE COAT, SPARK PLUG WITH CHROMATE COAT AND MANUFACTURING METHODS THEREOF

(75) Inventors: Hiroaki Nasu, Aichi (JP); Wataru Matsutani, Nagoya (JP); Yoshito Uemura, Kagoshima (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/791,867

(22) Filed: Feb. 26, 2001

(65) Prior Publication Data

US 2001/0050522 A1 Dec. 13, 2001

(30) Foreign Application Priority Data

Oct. 30, 2000 (JP) ..... 2000-330324
Feb. 24, 2000 (JP) ..... 2000-048335

(51) Int. Cl.[7] ..... F02M 57/06; F02P 13/00; H01T 13/00

(52) U.S. Cl. ..... 313/118; 445/7; 313/141

(58) Field of Search ..... ; 313/445, 118, 313/141, 143; 445/7; H01T 13/20

(56) References Cited

FOREIGN PATENT DOCUMENTS

| | | | |
|---|---|---|---|
| DE | 19638176 A1 | 4/1998 | ..... C23C/22/48 |
| JP | 2000-48930 | 2/2000 | ..... H01T/13/20 |

OTHER PUBLICATIONS

Abstract, DE 19638176 A1, Apr. 16,1998.

*Primary Examiner*—Sandra O'Shea
*Assistant Examiner*—Peter Macchiarolo
(74) *Attorney, Agent, or Firm*—Sughrue Mion, PLLC

(57) ABSTRACT

A metal member 55 (with a zinc plating layer 56 for prevention of corrosion) having a sliding expected surface that is expected to slide with the other member is immersed into a chromating bath containing a mixture of trivalent chromium salt and a complexing agent for trivalent chromium. And a chromate coat 57 having a film thickness of 0.2 to 0.5 $\mu$m and composed of trivalent chromium at 95 mass % or more of chromium component contained is formed at least on the sliding expected surface. Thereinafter, its chromate coat 57 is subjected to the heat treatment at temperatures from 85 to 255° C., thereby enhancing the sliding property of the chromate coat 57. As a result, the metal member 55 with chromate coat can be easily slid with the other member.

8 Claims, 8 Drawing Sheets

FIG. 8

| TEMPERATURE (°C) \ TIME (sec) | 30 | 60 | 120 | 180 | 240 | 300 | 480 | 600 | 900 | 1200 | 1500 | 1800 |
|---|---|---|---|---|---|---|---|---|---|---|---|---|
| 70 | × | × | × | × | × | × | × | × | × | × | × | × |
| 80 | × | × | × | × | × | × | × | × | × | × | × | × |
| 90 | △ | △ | △ | △ | ○ | ○ | ○ | ○ | ○ | ○ | ○ | ○ |
| 100 | △ | △ | ○ | ○ | ○ | ○ | ○ | ○ | ○ | ○ | ○ | ○ |
| 120 | △ | ○ | ○ | ○ | ○ | ○ | ○ | ○ | ○ | ○ | ○ | ○ |
| 140 | ○ | ○ | ○ | ○ | ○ | ○ | ○ | ○ | ○ | ○ | ○ | ○ |
| 150 | ○ | ○ | ○ | ○ | ○ | ○ | ○ | ○ | ○ | ○ | ○ | △ |
| 160 | ○ | ○ | ○ | ○ | ○ | ○ | ○ | ○ | ○ | ○ | △ | × |
| 180 | ○ | ○ | ○ | ○ | ○ | ○ | ○ | ○ | ○ | △ | × | × |
| 200 | ○ | ○ | ○ | ○ | ○ | ○ | ○ | ○ | △ | × | × | × |
| 210 | ○ | ○ | ○ | ○ | ○ | ○ | ○ | △ | × | × | × | × |
| 220 | ○ | ○ | ○ | ○ | ○ | ○ | △ | × | × | × | × | × |
| 240 | ○ | ○ | ○ | ○ | ○ | △ | × | × | × | × | × | × |
| 250 | ○ | ○ | ○ | ○ | △ | × | × | × | × | × | × | × |
| 260 | × | × | × | × | × | × | × | × | × | × | × | × |

METAL MEMBER WITH CHROMATE COAT, SPARK PLUG WITH CHROMATE COAT AND MANUFACTURING METHODS THEREOF

BACKGROUND OF THE INVENTION

1. Field of the Invention

The present invention relates to a metal member with chromate coat, a method for manufacturing the metal member with chromate coat, a spark plug, and a method for manufacturing the spark plug.

2. Description of the Related Art

The surface of a metal member is often plated for corrosion prevention. For example, in the iron-based material, the surface is often plated with zinc, and it is known that this zinc galvanization is subjected to sacrificial corrosion to present the excellent anti-corrosion. However, there is a drawback that zinc galvanization is consumed severely due to sacrificial corrosion, and changed into white color due to produced zinc oxide, impairing the appearance. Thus, the surface of a zinc plating layer is covered with a chromate coat to prevent the corrosion of the galvanizing layer.

Among the chromate coats, a yellow chromate coat is excellent in corrosion resistance, and is widely used in a broad area including can films, for example. Also, a spark plug used to ignite a gasoline engine in the internal combustion engine of, for example, the automobile, may be often applied with the yellow chromate coat to prevent the corrosion owing to the attack of acid components from inside the engine, or the influence of acid rain during transportation.

However, the yellow chromate coat contains a part of a chromium component in the form of hexavalent chromium, and is shunned increasingly from the respect of environmental problems. Also, there is another drawback that, because a treatment bath of the yellow chromate coat contains a relatively high density of hexavalent chromium, the waste disposal may be expensive. Further, there is another drawback that the yellow chromate coat is inferior in heat resistance, and if the temperature is elevated to about 100° C. or higher, the chromate coat is liable to degrade, and the corrosion resistance is rapidly decreased.

On the other hand, the trivalent chromium based chromate coat containing a small amount of hexavalent chromium is excellent in heat resistance, but was often insufficient in its sliding ability when trying to slide with the other member on the surface of a member formed with its chromate coat. For example, in a case that a plastic working which may accompany the sliding with metal such as caulking or deep drawing is applied on a metal member formed with the trivalent chromium based chromate coat, the deformation does not proceed uniformly, unless the sliding is excellently performed, leading to undesired shape or size, or causing a defect such as a crack on the chromate coat. Also, in the case where the chromate coat is formed on a threaded member such as a bolt or nut, it is difficult to rotate a screw smoothly, unless the sliding property is excellent, resulting in either a lower working efficiency or a damaged thread.

SUMMARY OF THE INVENTION

It is an object of the present invention to provide a metal member with chromate coat, a method for manufacturing the metal member with chromate coat, a spark plug and a method for manufacturing the spark plug, the chromate coat having a small content of hexavalent chromium, and being excellent in both the corrosion resistance and the sliding property.

In order to accomplish the above object, according to the present invention, there is provided a method for manufacturing a metal member with chromate coat including a chromate treatment step of forming a chromate coat having a film thickness of 0.2 to 0.5 $\mu$m and composed of trivalent chromium at 95 mass % or more of chromium component at least on an expected sliding surface by immersing the metal member, having the expected sliding surface that is expected to slide with another member, into a chromating bath, and a heat treatment step of heat treating its chromate coat at temperatures from 85 to 255° C.

In the invention, a chromate coat composed of trivalent chromium at 95 mass % or more of chromium component contained and having a film thickness of 0.2 to 0.5 $\mu$m (hereinafter referred to as a trivalent chromium based chromate coat) is formed on the surface of the metal member. That is, a normal yellow chromate coat has hexavalent chromium at about 25 to 35 mass % of chromium component, while the chromate coat of this invention contains as small as 5 mass % or less of hexavalent chromium relative to the chromium component, thereby being beneficial for the environment by reducing the hexavalent chromium. Also, a chromate treating solution for use has no content of hexavalent chromium component at all, or a considerably smaller content than the treating solution for the yellow chromate coat, as will be described later. Hence, it is not required to make the reduction of hexavalent chromium, which is needed in the waste disposal of hexavalent chromium, resulting in less drainage problems.

As a result of acute examination, the present inventors have found that if the trivalent chromium based chromate coat is heat-treated in a temperature range from 85 to 255° C., the sliding property of trivalent chromium based chromate coat formed on the expected sliding surface of the metal member can be enhanced, whereby this invention has been accomplished.

The trivalent chromium based chromate coat is formed in a wet process, and contains much moisture immediately after forming the film. And if such moisture remains in excessive quantity particularly on the surface of chromate coat, an undesired adsorptive force is developed with the sliding member due to this moisture, and may possibly degrade the sliding ability. Thus, this moisture is subjected to the heat treatment in the above-mentioned temperature range to dry the film adequately, so that the sliding property of the chromate coat can be improved.

By heating the film, the film shrinks and is hardened. Such shrinkage may possibly be caused due to the fact that the hydrated chromate constituting the film is dewatered by heating. Further, as a result of acute examination, it has been found that trivalent chromium based chromate coat shrinks to some extent when a heat history is applied, but is hardened and becomes finer without causing almost any cracks, whereby in sliding, the chromate coat is unlikely to peel from a substrate (e.g., a zinc plating layer), and expose the substrate to give rise to increased sliding friction. Also, the peeling dust that may possibly decrease the sliding ability is unlikely to occur. Consequently, the sliding property can be improved.

At the heat treatment temperatures less than 85° C., the sliding property can not be effectively improved. On the other hand, at the heat treatment temperatures above 255° C., the sliding property is rather decreased, and the film peeling or lower corrosion resistance may be incurred along with the sliding. This is because if the heat treatment temperature is too high, the chromate coat is excessively hardened and becomes fragile. The heat treatment process may be performed in the air (or atmosphere), or in an inert atmosphere such as a nitrogen gas or Ar gas, for example. The heat treatment temperature is preferably in a range from 90 to 250° C.

If the film thickness of the chromate coat is below 0.2 μm, the anti-corrosion performance or heat resistance can not be sufficiently secured. Also, if the film thickness is above 0.5 μm, the film is more likely to crack or fall in sliding. The film thickness of the chromate coat is desirably 0.3 to 0.5 μm. It is desired that the chromate coat does not contain substantially hexavalent chromium.

The metal member can be a metal shell of a spark plug caulked against the outside of an insulator. In this case, when the metal shell is caulked against the insulator, a chromate coat is formed on an outside face of the metal shell containing an expected sliding surface, which is defined as a surface of an expected caulking portion of the metal shell expected to contact and slide with a caulking mold, and after the heat treatment process, the metal shell can be caulked with the expected caulking portion directed toward the insulator.

A method for manufacturing a spark plug according to the invention includes a caulking step of caulking a barrel-like metal shell against an insulator by inserting an axial insulator in an axial direction through an inserting opening portion into the metal shell, compressing a sliding expected surface of a caulking expected portion formed in the opening portion in the axial direction, while contacting and sliding with a caulking mold, and bending the caulking expected portion toward the insulator, a chromate treatment step of forming a chromate coat composed of trivalent chromium at 95 mass % or more of chromium component contained and having a film thickness of 0.2 to 0.5 μm at least on the expected sliding surface by immersing the metal shell in a chromating bath, and a heat treatment step of heat-treating the chromate coat at temperatures from 85 to 255° C., wherein the heat treatment step is performed before the caulking step.

When manufacturing the spark plug, if the sliding property between the metal shell and the caulking mold is worse, the chromate coat formed on the metal shell may cause a defect such as a crack, or an undesired force may be applied in caulking to increase the size of a tool engaging portion (a hexagonal portion) for the metal shell. Thus, the chromate coat of the invention is formed on the metal shell of the spark plug, and is subjected to the heat treatment within the scope of the invention. Then if the caulking step of caulking the metal shell against the insulator is made, the sliding property between the metal shell and the caulking mold is enhanced, so that the chromate coat formed on the surface of the metal shell causes less defects such as cracks. And the undesired broadening of the size of the tool engaging portion (so-called hexagonal portion) of the metal shell can be suppressed.

With the above method for manufacturing the metal member with chromate coat according to the invention, the metal member with chromate coat can be produced. That is, the metal member with chromate coat having a sliding face expected to slide or having already slid with the other member (hereinafter generically referred to as a sliding expected surface) is formed with a chromate coat composed of trivalent chromium at 95 mass % or more of chromium component and having a film thickness of 0.2 to 0.5 μm at least on the sliding expected surface, in which the hardness of the sliding expected surface formed with the chromate coat is in a range from 1500 to 3000 N/mm$^2$, in universal hardness (HU), measured under a pressing load of 40 mN for an indenter in accordance with a method as defined in the German standards DIN50359-1.

A spark plug of the invention can be produced by employing a metal member with a chromate coat according to the invention as a metal shell of the spark plug. That is, the spark plug has the metal shell caulked against the outside of an insulator, the metal shell is the metal member, and the expected sliding surface is an outer face of a caulking portion for the metal shell.

By subjecting the chromate coat to the heat treatment as described above, the water content of the chromate coat is removed, so that the chromate coat is made finer and hardened. The present inventors made the measurement of the surface hardness for a metal member with chromate coat having an excellent sliding property with the heat treatment, and found that the chromate coat have a range of hardness suitable to enhance the sliding property. Namely, the metal member with chromate coat having the universal hardness (HU) of the sliding expected surface in a range from 1500 to 3000 N/mm$^2$ under a pressing load of 40 mN at the time of measurement has an excellent sliding property and can smoothly slide with the other member.

The chromate coat formed on the surface of the metal shell, particularly when applied to the spark plug, has less cracks even after caulking, and the broadening of the size of the tool engaging portion can be suppressed. As a result, when a lot comprised of a plurality of spark plugs is produced, it is possible to reduce the variation in the size of the tool engaging portion (e.g., hexagonal portion) formed on an outer peripheral face of each metal shell for the spark plug included within the lot. Thereby, there is less incidence of the spark plugs having the size of the tool engaging portion outside the tolerance, contributing to the improved manufacturing yield.

In the invention, a chromating bath for forming the chromate coat preferably contains a mixture of trivalent chromium salt, and a complexing agent for trivalent chromium. By employing such a chromating bath, a fine and thick trivalent chromium based chromate coat that is difficult to make in accordance with the typical chromate treating method can be formed, and further the chromate coat having a suitable film thickness of 0.2 to 0.5 μm can be easily formed. For such a method for forming the chromate coat, the details were disclosed in German Patent DE19638176A1. The outline of the method will be described below.

According to a theory, in a process for forming the chromate coat, a substrate metal (e.g., zinc) is first oxidized and eluted in a treatment bath, a substrate metal component eluted and a solution containing chromate ions are reacted, so that trivalent chromium forms a polymer complex of a bridge of hydroxyl group or oxygen to settle or sediment in gel on the interface of substrate metal. In this case, for the growth of the chromate coat, the elution of substrate metal and the reaction and sedimentation of the eluted substrate metal and chromate ions must progress in parallel. However, if the chromate coat sediments to some extent, the elution reaction of a substrate metal layer that is a heterogeneous reaction via an interface with the solution is prevented, so that the growth of the chromate coat is retained.

According to the disclosed content of German Patent DE19638176A1, in order to produce a thicker chromate coat, it is important that the elution of substrate metal and the sedimentation of chromate coat due to reaction between the eluted substrate metal component and trivalent chromium are effected at the greater rate, while the rate of reverse dissolution of the chromate coat is made as small as possible. By the above method, an appropriate complexing agent is added into the bath to make trivalent chromium complex to promote the sedimentation of film, and allow the thicker film to be produced.

As the complexing agents, various sorts of chelating agents may be effectively employed, such as dicarboxylic acid, tricarboxylic acid, hydroxy acid, hydroxyl group dicarboxylic acid or hydroxyl group tricarboxylic acid, for example, oxalic acid, malonic acid, succinic acid, glutaric acid, adipic acid, pimalic acid, cork acid, selenious acid, sebacic acid, maleic acid, phthalic acid, terephthalic acid, tartaric acid, citric acid, malic acid, and ascorbic acid. Other complexing agents may be employed. Usable complexing agents were disclosed in the German Patent described previously.

It is preferable to set the chromating bath at a temperature from 20 to 80° C. And the immersing time of the subject in the chromating bath is preferably 20 to 80 seconds. First, if the temperature of the bath is below 20° C., the film thickness of the chromate coat formed can not be obtained sufficiently. On the other hand, if the temperature of the bath is 80° C. or greater, the evaporation of water content from the bath is so vigorous that the bath condition becomes less accurate. Also, if the immersing time is below 20 seconds, the sufficient chromate coat may not be formed. On the other hand, if the immersing time is beyond 80 seconds, the formed chromate coat becomes too thick, causing a crack on the film, or an exfoliation of the film.

The heat treatment time must be long enough to secure the sliding property in the chromate coat obtained after the heat treatment. The lower limit and the upper limit of the heat treatment time are varied depending on the heat treatment temperature, and the upper limit of the heat treatment time required is shifted to the shorter time side as the heat treatment temperature rises. Specifically, the heat treatment process is performed in a condition satisfying any one of the following conditions, $$30 \leqq t \leqq 1800 \text{ for } 85 \leqq T \leqq 155$$

$$30 \leqq t \leqq 1500 \text{ for } 155 < T \leqq 170$$

$$30 \leqq t \leqq 1200 \text{ for } 170 < T \leqq 190$$

$$30 \leqq t \leqq 900 \text{ for } 190 < T \leqq 205$$

$$30 \leqq t \leqq 600 \text{ for } 205 < T \leqq 215$$

$$30 \leqq t \leqq 480 \text{ for } 215 < T \leqq 230$$

$$30 \leqq t \leqq 300 \text{ for } 230 < T \leqq 245$$

$$30 \leqq t \leqq 240 \text{ for } 245 < T \leqq 255$$

where the heat treatment temperature is T (° C.) and the heat treatment time is t (sec).

In any of the conditions, if the heat treatment time is set to be longer than the lower limit, the obtained chromate coat can significantly enhance the sliding property.

The heat treatment process is more preferably performed in a condition satisfying any one of the following conditions, $$210 \leqq t \leqq 1800 \text{ for } 85 < T \leqq 95$$

$$90 \leqq t \leqq 1800 \text{ for } 95 < T \leqq 110$$

$$45 \leqq t \leqq 1800 \text{ for } 110 < T \leqq 130$$

$$30 \leqq t \leqq 1800 \text{ for } 130 < T \leqq 145$$

$$30 \leqq t \leqq 1500 \text{ for } 145 < T \leqq 155$$

$$30 \leqq t \leqq 1200 \text{ for } 155 < T \leqq 170$$

$$30 \leqq t \leqq 900 \text{ for } 170 < T \leqq 190$$

$$30 \leqq t \leqq 600 \text{ for } 190 < T \leqq 205$$

$$30 \leqq t \leqq 480 \text{ for } 205 < T \leqq 215$$

$$30 \leqq t \leqq 300 \text{ for } 215 < T \leqq 230$$

$$30 \leqq t \leqq 240 \text{ for } 230 < T \leqq 245$$

$$30 \leqq t \leqq 180 \text{ for } 245 < T \leqq 255$$

where the heat treatment temperature is T (° C.) and the heat treatment time is t (sec).

From the experiments made by the present inventors, it was found that the heat treatment enhances the sliding property, while the excessive heat treatment degrades the sliding property. And the heat treatment time t (sec) in a permissible range to enhance the sliding property satisfies the following condition:

$$t \leqq 0.94 \times \exp(4201/T) \quad (1)$$

where the heat treatment temperature is T (K). If the heat treatment time t (sec) is set to be shorter than the upper limit, the excessive heat treatment can be prevented, so that the sliding property can be improved. Note that the heat treatment time t (sec) is more desirably set such that $$t \leqq 0.038 \times \exp(4489/T) \quad (2)$$

BRIEF DESCRIPTION OF THE DRAWINGS

FIG. 8 is a table showing the results of the experiment of assessing the sliding property in the example;

DETAILED DESCRIPTION OF THE PREFERRED EMBODIMENT

Figure 2:
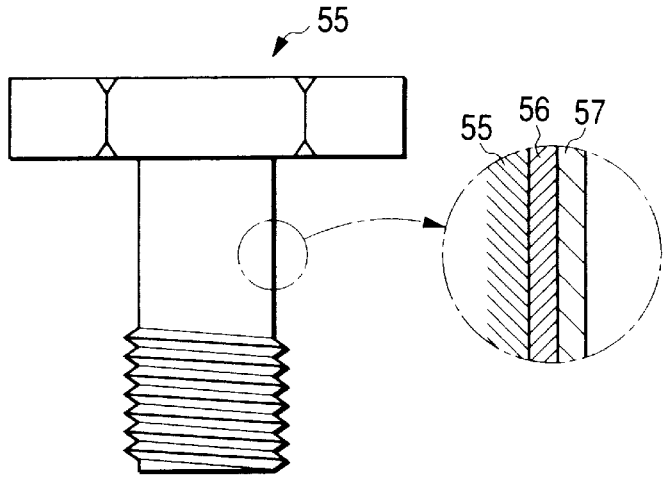
FIG. 2 is a schematic view illustrating one example of a metal member with chromate coat according to the invention.

The preferred embodiments of the present invention will be described below with reference to the drawings. FIG. 2 illustrates one example of a metal member 55 having a chromate coat formed on its surface. First of all, the metal member 55 (e.g., a bolt or nut) having a sliding expected surface is formed with a zinc plating layer 56. The zinc plating layer 56 is formed by a well-known electrolytic zinc galvanizing method to prevent corrosion of the metal member 55. The thickness of the zinc plating layer 56 formed is preferably about 5 to 15 μm, for example. If the thickness of the zinc plating layer 56 is below 5 μm, it is difficult to secure the corrosion resistance sufficiently, while if it is above 15 μm, the zinc plating layer 56 is over specification from the standpoint of securing the corrosion resistance, resulting in the longer galvanizing time, and leading to the lower manufacturing efficiency.

A chromate coat 57 is formed on the metal member 55 having the zinc plating layer 56. The chromate coat 57 formed has a film thickness of 0.2 to 0.5 μm, and is preferably composed of trivalent chromium at 95 mass % or more of chromium component, and more preferably, composed of trivalent chromium for substantially all the chromium component.

Figure 3:
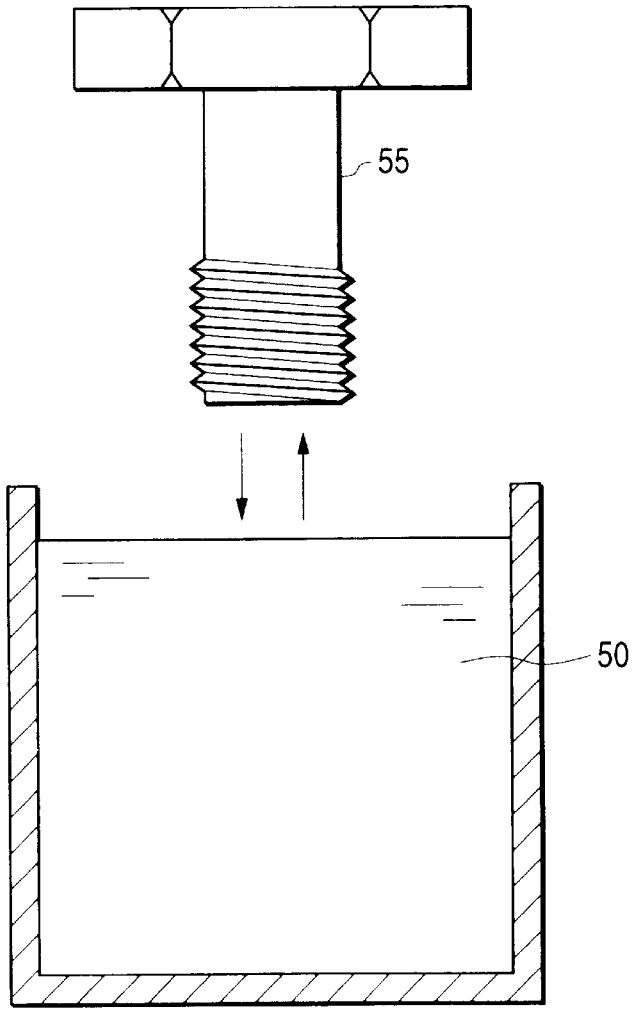
FIG. 3 is a view for explaining a process of forming a chromate coat on the metal member.

FIG. 3 typically illustrates one example of a chromate treatment for forming the chromate coat 57 on the metal member 55. The metal member having the zinc plating layer 56 is immersed in a chromating bath 50. The chromating bath as previously described can be effectively employed. With such a treatment, the chromate layer 57 is formed on the surface of the zinc plating layer 56 for the metal member 55. In the chromate treatment, a well-known barrel processing (a processing which is performed while rotating a liquid transparent container in the treatment bath 50 by bulk loading the metal members into the container) can be adopted to improve the treatment efficiency.

Figure 4:
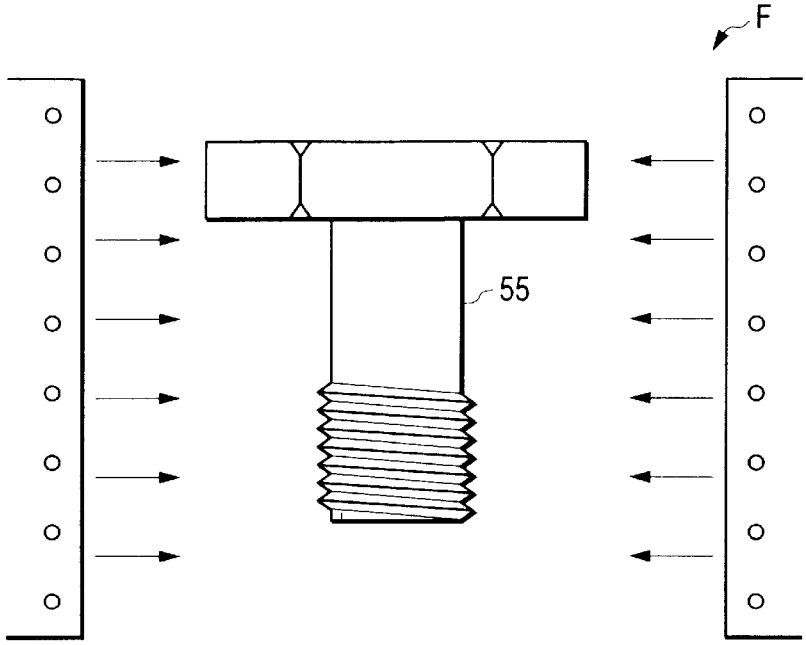
FIG. 4 is a view for explaining a process of heat-treating the chromate coat formed on the metal member.

After the chromate treatment, the metal member 55 is rinsed, and further heat-treated at temperatures from 85 to 255° C. in the atmosphere (or in the inert atmosphere composed of an Ar gas or nitrogen gas), using a heat treatment furnace F as shown in FIG. 4. Thereby, the water content in the chromate coat is removed, so that the sliding property of the chromate coat is possibly improved. Note that the metal member 55 after the chromate treatment may be rinsed, and then dried by the hot air at temperatures from 50 to 70° C. to perform the above heat treatment.

For the metal member 55 with chromate coat as produced in the above way, the water content in the chromate coat 57 is dewatered by heat treatment, so that the hardness of the chromate coat 57 may be increased. As a result of measuring the universal hardness (HU) of the chromate coat 57 after heat treatment, it was confirmed that the hardness was increased. From the standpoint of enhancing the sliding property, the hardness of the chromate coat 57 may be preferably in a range from 1500 to 3000 N/mm$^2$, in universal hardness (HU), measured under a pressing load of 40 mN.

Figure 1:
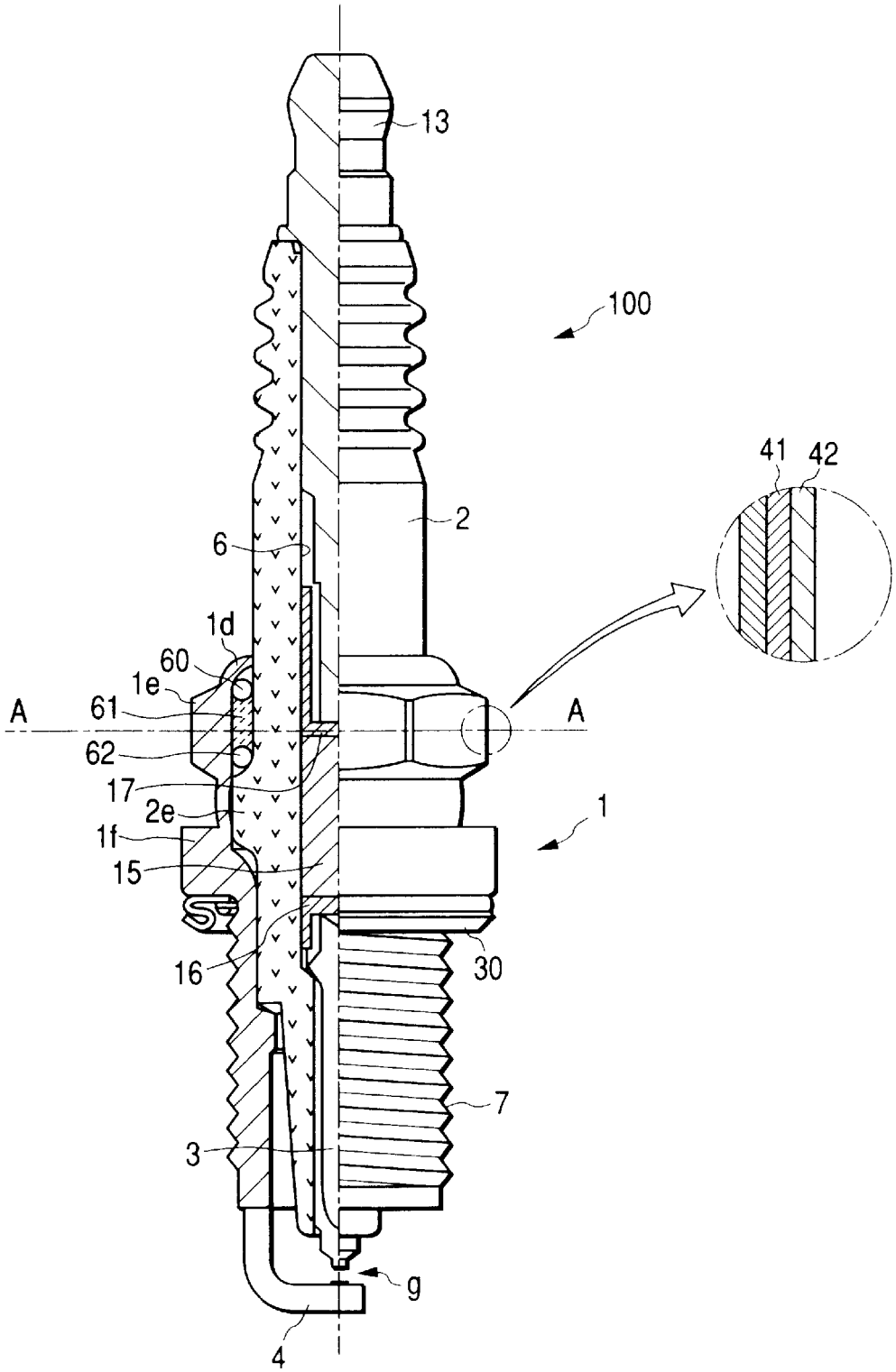
FIG. 1 is a longitudinal cross-sectional view schematically illustrating a spark plug of the present invention.

In this invention, the spark plug may be produced by applying the chromate treatment on the metal shell of the spark plug, and employing the metal shell having the chromate coat formed. An embodiment will be described below in which the chromate coat is formed on the metal shell of the spark plug. First, a spark plug 100 is schematically illustrated in FIG. 1. This spark plug 100 comprises a barrel-like metal shell 1, an insulator 2 fitted into the metal shell 1 with its leading end portion protruded therefrom, a center electrode 3 provided inside the insulator 2 in a state where its top end portion is protruded, and a ground electrode 4 having one end connected with the metal shell 1 and the other end opposed to the top end of the center electrode 3. A spark discharge gap g is formed between the ground electrode 4 and the center electrode 3.

The insulator 2 is composed of a ceramic sintered body such as alumina or aluminum nitride, and has a through hole 6 for fitting the center electrode 3 along its axial direction. A terminal fitting 13 is inserted and secured on one end side of the through hole 6 (hereinafter this end side is defined as a rear side), and the center electrode 3 is inserted and secured on the other end side (hereinafter this end side is defined as a fore side). Within this through hole 6, a resistor 15 is disposed between the terminal fitting 13 and the center electrode 3. Both end portions of this resistor 15 are electrically connected via the conductive glass seal layers 16, 17 to the center electrode 3 and the terminal fitting 13, respectively.

The metal shell 1 is formed in cylindrical shape of a metal such as carbon steel, and constitutes a housing for the spark plug 100, with a threaded portion 7 formed around its outside peripheral face to attach the plug 100 on an engine block, not shown. Reference numeral 1*e* denotes a tool engaging portion for engaging a tool such as a spanner or wrench, in attaching the metal shell 1 on an internal combustion engine, and having a hexagonal shape in axial cross section. On the other hand, a ring-like wire packing 62 engaging a peripheral edge on the rear side of a flange-like protruding portion 2*e* is disposed between an inner face of an opening portion on the rear side of the metal shell 1 and an outer face of the insulator 2. Further rearward therefrom, a ring-like packing 60 is disposed via a filling layer 61 made of talc. And the insulator 2 is pushed around the metal shell 1 on the fore side, and an opening edge of the metal shell 1 is caulked inward against the packing 60 in this state, thereby forming a caulked portion 1*d*, so that the metal shell 1 is secured with the insulator 2.

On a base end portion of the threaded portion 7 for the metal shell 1, a gasket 30 is fitted. This gasket 30 is a ring-like part produced by bending a metal plate made of carbon steel. By screwing the threaded portion 7 into a tapped hole on the cylinder head side, the gasket 30 is compressed axially and collapsed between a flange-like gas seal portion 1*f* on the side of the metal shell 1 and a peripheral edge portion of the tapped hole, playing a role of sealing a gap between the tapped hole and the threaded portion 7.

In this invention, after the chromate coat is formed on the metal shell 1, this metal shell 1 is caulked against the insulator 2 to produce the spark plug 100. A method of forming a chromate coat 42 on the metal shell 1 is the same as that of forming the chromate coat 57 on the metal member 55, as previously described. That is, first of all, the metal shell 1 is formed with a zinc plating layer 41 for prevention of corrosion. This zinc plating layer 41 is formed by the well-known electrolytic zinc galvanizing method. The thickness of the film is preferably about 3 to 9 μm.

The metal shell 1 formed with the zinc plating layer 41 is immersed in the chromating bath 50 to form the chromate coat 42 in the same way as with the metal member 55. The chromate coat 42 formed is preferably composed of trivalent chromium at 95 mass % or more of chromium component and has a film thickness of 0.2 to 0.5 μm. The chromium component is preferably composed of trivalent chromium as much as possible, and more preferably is composed of trivalent chromium for substantially all the chromium component. The metal shell 1 after chromate treatment is rinsed, and then heat-treated in the heat treatment furnace F in a temperature range from 85 to 255° C., like the metal member 55, as previously described. By performing the heat treatment in the above temperature range, the sliding property of the chromate coat is enhanced.

The metal shell 1 after heat treatment is incorporated into the spark plug 100 by being caulked against the insulator 2, as shown in FIG. 1. A process of caulking the metal shell 1 against the insulator will be described below in FIG. 5A. A top end portion of the metal shell 1 is inserted through a set hole 110*a* of a caulking base 110, to support a flange-like gas seal portion 1*f* formed on the metal shell 1 around a peripheral edge of the opening. Then, a caulking mold 111 is brought into contact with the metal shell 1 in an axial direction of the metal shell 1, and held. In this state, by applying an axial force on the caulking mold 111, a sliding motion occurs between an expected sliding surface 200*a* of an expected caulking portion 200 for the metal shell 1 and the caulking mold 111, so that the expected caulking portion 200 of the metal shell 1 is bent toward the insulator 2 to caulk the metal shell 1 against the insulator 2 (FIG. 5B). And a seal is made between an inserting opening portion 1*p* of the metal shell 1 and an outer peripheral face of the insulator 2. Lastly, the ground electrode 4 is welded to the metal shell 1, with the size of the spark discharge gap g adjusted, to complete the spark plug 100.

Figure 5A:
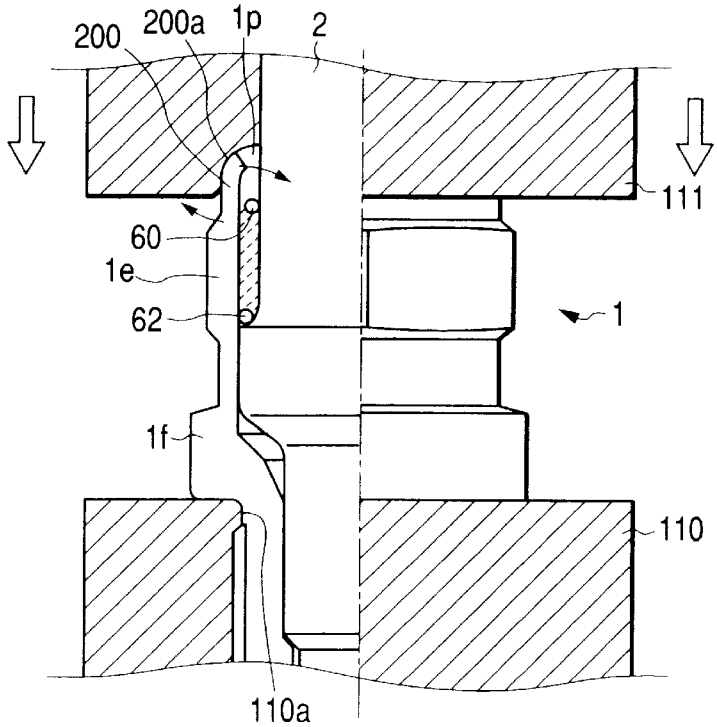
FIGS. 5A and 5B are views for explaining a process of caulking a metal shell of the spark plug against an insulator.
Figure 5B:
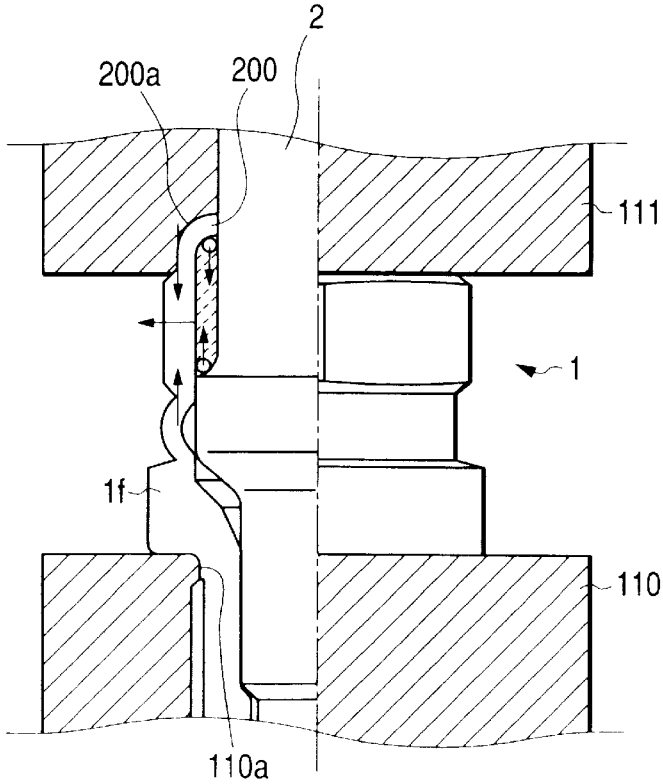

In a caulking process as shown in FIGS. 5A and 5B, if the sliding property is worse between the metal shell 1 and the caulking mold 111, the chromate coat 42 formed on the metal shell 1 causes a defect such as a crack, or an undesirable force may be applied in caulking to broaden the size of the tool engaging portion (so-called hexagonal portion) 1*e* of the metal shell 1. Thus, by heat-treating the metal shell 1 of the spark plug within the scope of this invention, and then caulking the metal shell 1 against the insulator 2, the sliding property between the metal shell and the caulking mold can be enhanced. As a result, it is possible to reduce the defect, such as a crack on the chromate coat formed on the surface of the metal shell, and suppress undesirable broadening of the size of the tool engaging portion (so-called hexagonal portion) 1*e* of the metal shell 1.

The metal shell of the spark plug is employed as the metal member with chromate coat to examine the effects of the present invention. This example is involved in the metal shell of the spark plug, but only illustrative. The present invention can be effectuated in various modifications or variations on the basis of the knowledge of those skilled in the art without departing from the scope or spirit of the invention.

Using a carbon steel wire SWCH8A for the cold heading and cold forging, defined in JIS-G3539, as a raw material, the metal shell 1 of FIG. 1 was produced by cold forging. The designation of the threaded portion 7 for the metal shell 1 was M14, with an axial length of about 19 mm. Then, by making a well-known electrolytic zinc galvanizing treatment using an alkaline cyanide bath, a zinc plating layer 56 having a film thickness of about 5 $\mu$m was formed.

Then, the chromating bath 50 was constructed by dissolving trivalent chromium chloride ($CrCl_3.6H_2O$) of 50 g, cobalt (II) nitrate ($Co(NO_3)_2$) of 3 g, sodium nitrate ($NaNO_3$) of 100 g and malonic acid of 31.2 g per liter of the deionized water, and held at a liquid temperature of 60° C. by a heater, whereby pH of the bath was adjusted at 2.0 by the addition of caustic soda. And the metal shell 1 after zinc galvanizing was immersed for 60 seconds in the chromate treating solution 50, then rinsed, and dried temporarily by the hot air at 70° C. for 180 seconds to form a trivalent chromium based chromate coat (specimen A).

On the other hand, a yellow chromating bath was prepared by dissolving chromic acid anhydride 7 g per liter, sulfuric acid 3 g per liter, and nitric acid 3 g per liter in the deionized water, and held at a liquid temperature of 20° C. And the metal shell was immersed for about 15 seconds in the yellow chromating bath, lifted, and dried by the hot air at 70° C. to form a chromate coat (specimen B: comparative example).

Figure 7:
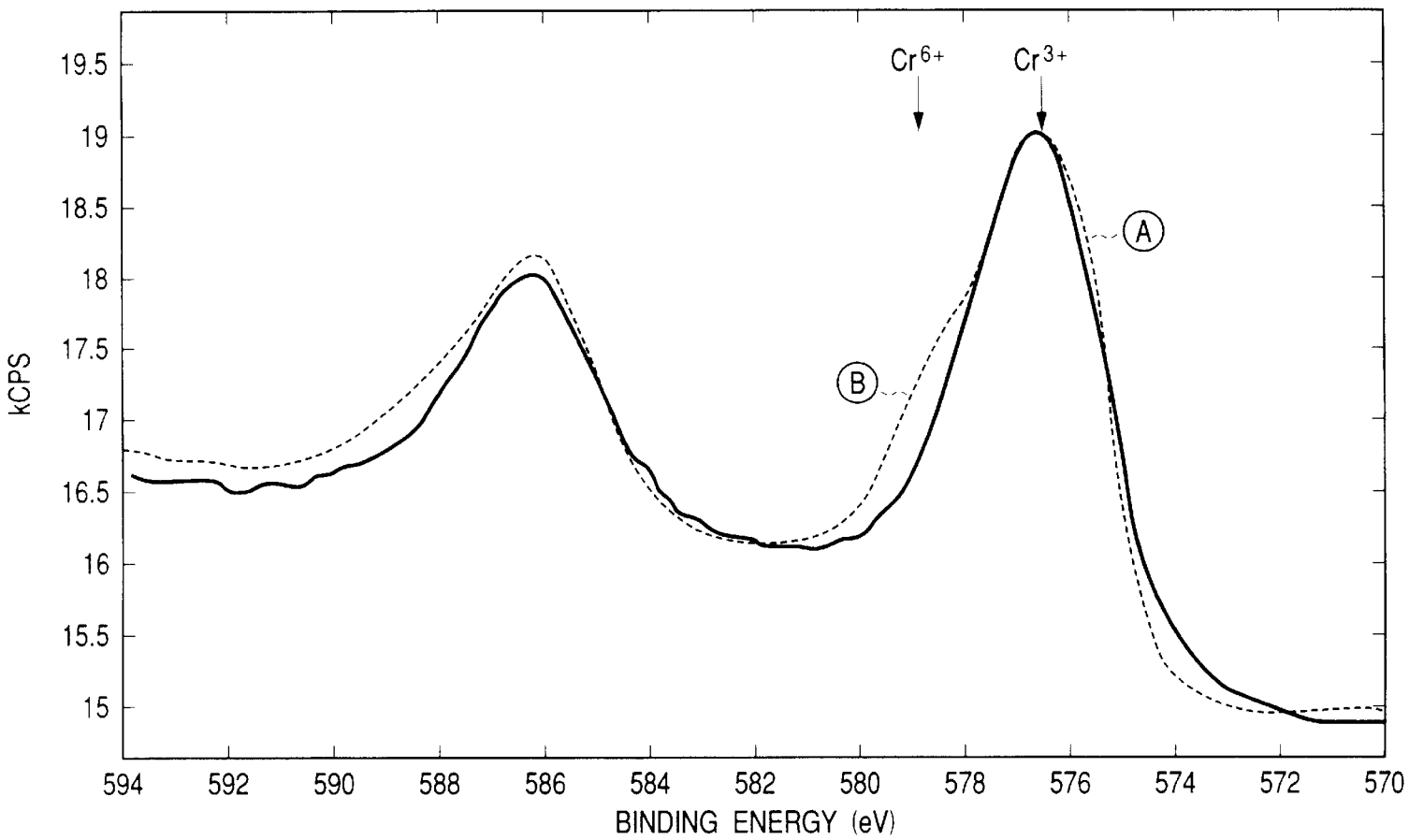
FIG. 7 is a graph (around a peak portion of chromium ($2p_{2/3}$) for the photoelectron spectrum) showing the results of the X-ray photoelectron spectroscopic analysis for the chromate coat of the specimens A and B in this example.

The existing state of chromium in the chromate coat of each specimen was examined by the X-ray photoelectron spectroscopic analysis (XPS). FIG. 7 shows the peaks of chromium ($2p_{2/3}$) in the photoelectron spectrum for the specimens A and B. For a specimen A (solid line), it can be observed that no peak appears at the position corresponding to hexavalent chromium and almost all the chromium component is trivalent chromium. On the other hand, for a specimen B, a peak of hexavalent chromium overlaps a peak of trivalent chromium, and a rising part like a gall appears over a shoulder on the higher energy side from the peak.

Then, the specimen A after temporary drying was heat-treated at temperatures from 85 to 255° C. for 30 to 1800 seconds in the heat treatment furnace F to produce the metal shell 1 as a member with chromate coat according to the invention. Also, the heat treatment was performed under the other condition to produce a comparative specimen. In the spark plug of the invention after heat treatment, the film thickness of chromate coat formed was measured actually from the cross section with SEM. The measurements with SEM revealed that the thickness of chromate coat was in a range from 0.2 to 0.5 $\mu$m, and the chromate coat having an excellent film thickness was formed.

For the above specimens, the following experiment was conducted to assess the sliding property. The axial insulator 2 was inserted through the inserting opening portion 1*p* around the metal shell 1 subjected to the chromate treatment and heat treatment under respective conditions to caulk the metal shell 1 against the insulator 2. At this time, visually measuring the situation of fissure or crack occurring on the surface of the caulking portion 1*d* formed on the metal shell 1, the assessment of the sliding property was conducted. The assessment was indicated by "○" when almost no fissure or crack was found, "Δ" when minute fissure or crack was only found, and "X" when large fissure or crack was found. The experiment results are shown in FIG. 8.

According to the experiment results, the specimen A subjected to the heat treatment within the scope of the invention had no fissure or crack when the caulking portion of the metal shell is caulked, whereby the caulking process was performed excellently. On the other hand, if the metal shell subjected to the heat treatment outside the above range was caulked against the insulator of the spark plug, the fissure or crack occurred in the caulking portion of the metal shell. Also, there was the problem that the tool engaging portion (so-called hexagonal portion) 1*e* for the metal shell 1 was broadened in size, when compressed axially by the caulking mold, due to worse sliding property.

Figure 9:
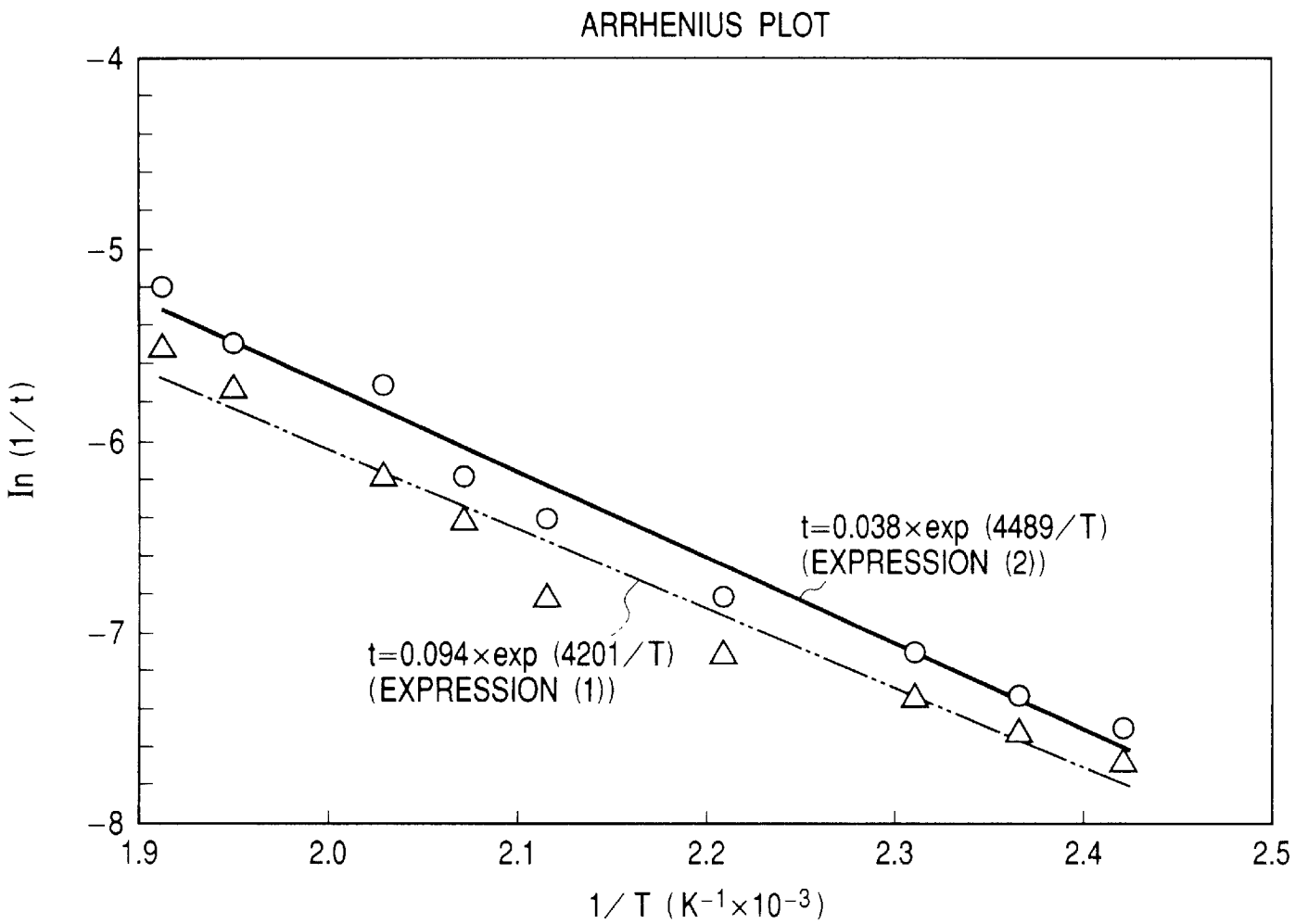
FIG. 9 is a graph plotting the upper limit of heat treatment time with respect to the heat treatment temperature, on the basis of the results of experiment in FIG. 8.

FIG. 9 is a graph plotting in semilogarithmic scale the inverse (represented by the plot point "Δ" in the graph) of the value t1 at which the result of assessment is turned from bad (X) to excellent (Δ), and the inverse (represented by the plot point "○" in the graph) of the value t2 at which it is turned from excellent (Δ) to superior (○) with respect to the inverse of the heat treatment temperature T (absolute temperature), regarding the heat treatment time t at each temperature for the specimen A. This graph has the boundary lines between the time and the temperature drawn, which are recommended by the following expressions (1) and (2):

$$t=0.038\times\exp(4489/T) \quad (1)$$

$$t=0.094\times\exp(4201/T) \quad (2)$$

If the heat treatment is conducted on the longer time side or higher temperature side (on the left lower side of the graph) than the straight line as given in expression (2), the assessment of the sliding property is changed from Δ to X. Also, if the heat treatment is conducted under the condition on the longer time side or higher temperature side (on the left lower side of the graph) than the straight line as given in expression (1), the assessment of the sliding property is changed from ○ to Δ. Namely, it can be found that the metal shell heat-treated under the condition of $t \leqq 0.094\times\exp(4201/T)$ is unlikely to cause the fissure or crack in the caulking portion, even if caulked against the insulator in the manufacturing process of the spark plug. Further, it can be found that the metal shell heat-treated under the condition of $t \leqq 0.038\times\exp(4489/T)$ is more unlikely to cause the fissure or crack in the caulking portion.

Then, the variation in hardness of the chromate coat was examined when the heat treatment condition for the chromate coat was changed. A test method for measuring the hardness of chromate coat was a universal hardness test as previously described. In the same spark plug, the universal hardness was measured on an outer peripheral face (or the expected sliding surface 200*a*) of the caulking portion 1*d* for the metal shell 1 and an outer peripheral face of the tool engaging portion (so-called hexagonal portion) 1*e* under a pushing load of 40 mN, and it was found that almost the same values could be measured. Accordingly, in the measurement of the universal hardness in this example, the universal hardness was measured on the outer peripheral face of the tool engaging portion where the measurement was easier. The above results are shown in Table 1. From the results of Table 1, it can be understood that the chromate coat subjected to the heat treatment within the scope of the invention has a hardness of 1500 to 3000 N/mm$^2$ in the universal hardness (HU), with excellent sliding property.

TABLE 1

| | Heat treatment | | Universal hardness | |
|---|---|---|---|---|
| | Temperature (° C.) | Time (sec) | (HU) [N/mm$^2$] | assessment result of Sliding property |
| 1 | No heat treatment* | | 1220* | X |
| 2 | 100 | 240 | 2300 | ○ |
| 3 | 150 | 240 | 2600 | ○ |
| 4 | 200 | 1800* | 3200* | X |
| 5 | 240 | 240 | 2780 | ○ |
| 6 | 200 | 480 | 2650 | ○ |
| 7 | 240* | 900* | 3100* | X |
| 8 | 260* | 300 | 3040* | X |

A sign * indicates outside of the scope of the invention.

Figure 6:
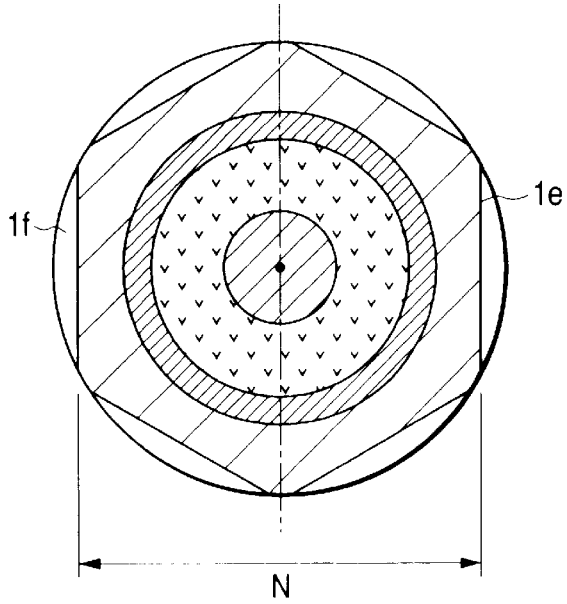
FIG. 6 is a cross-sectional view taken along the line A—A in FIG. 1, for explaining the definition of the size N of a tool engaging portion in the spark plug.

Using the metal shell 1 heat-treated under the same conditions, the spark plugs were produced under the same conditions. For an arbitrary number X of spark plugs, the size N (mm) of the tool engaging portion (what is called the hexagonal portion) was measured. Then, the average value m of the size N (mm)=the sum of N/X (mm) was calculated. The size of the tool engaging portion (so-called hexagonal portion) 1*e* for the spark plug is defined as in FIG. 6. FIG. 6 is a cross-sectional view (of the tool engaging portion 1*e*) taken along the line A—A in FIG. 1. As an example, the tool engaging portion is illustrated in the case of a hexagonal shape in axial cross section, but the shape of the tool engaging portion in axial cross section is not limited thereto. Herein, the size N (mm) of the tool engaging portion means the minimum interval N (mm) between the circumscribing parallel lines for the visible outline of the tool engaging portion 1*e* in axial cross section.

Figure 10:
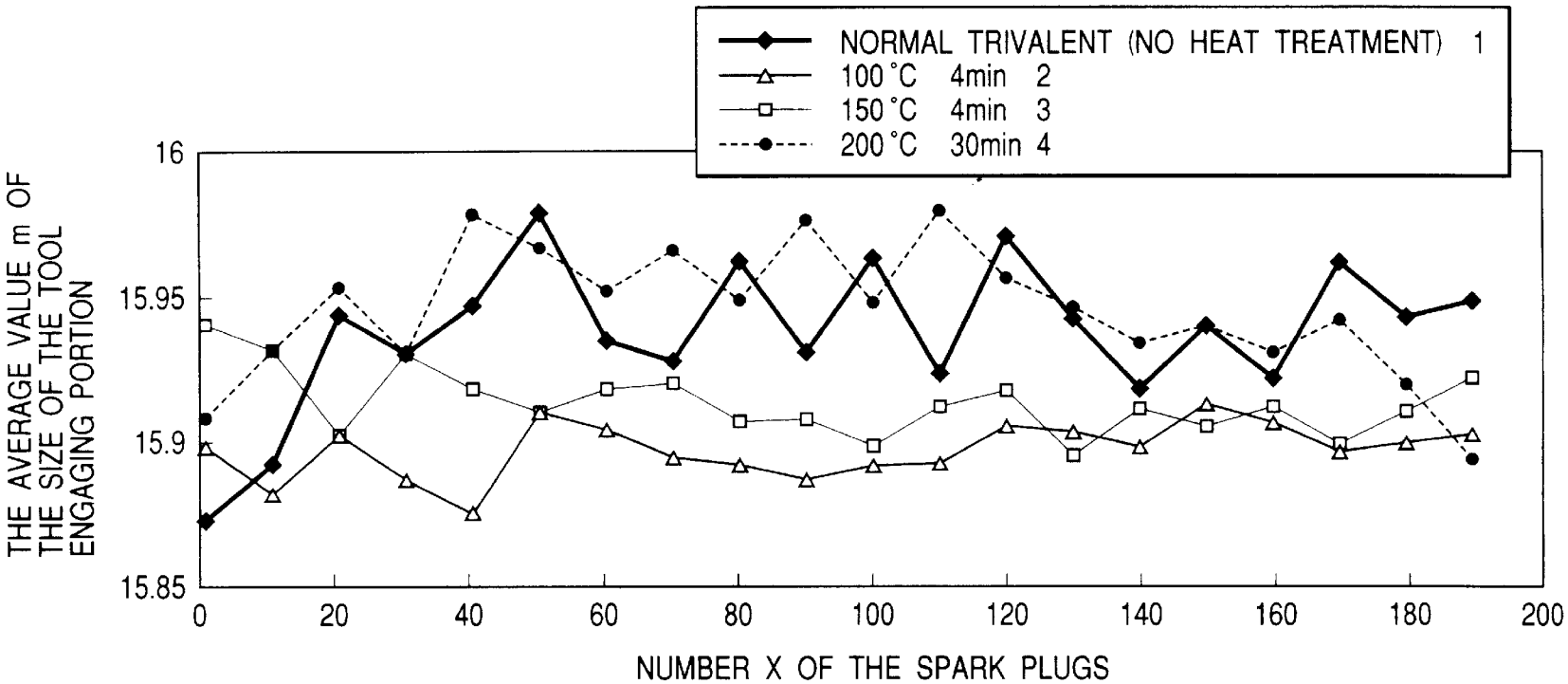
FIG. 10 is a view showing the relation between the heat treatment condition and the broadening of the size N for the tool engaging portion.

The relation between the number of measurements X and the average value m (mm) of N (mm) is shown in FIG. 10. As can be seen from FIG. 10, the spark plug produced by the manufacturing method of the invention has the less broadening of the size N (mm), when the size N (mm) of the tool engaging portion (so-called hexagonal portion) 1*e* for the metal shell 1 is measured. Therefore, it is possible to avoid the problem that the tool screwed into the internal combustion engine can not be fitted into the tool engaging portion (hexagonal portion) 1*e* of the spark plug.

What is claimed is:

1. A method for manufacturing a metal member with chromate coat comprising:

forming a chromate coat having a film thickness of 0.2 to 0.5 μm and composed of trivalent chromium at 95 mass % or more of chromium component contained at least on a surface of said metal member by immersing said metal member into a chromating bath;

conducting the heat treatment of said chromate coat at temperatures from 85 to 255° C.;

forming said chromate coat on an outside surface of said metal member containing a sliding expected surface, in which said sliding expected surface is defined as a surface of a caulking expected portion of said metal member that is expected to contact and slide with a caulking mold in caulking; and caulking said caulking expected portion after said heat treatment step.

2. A method for manufacturing a metal member with chromate coat comprising:

forming a chromate coat having a film thickness of 0.2 to 0.5 μm and composed of trivalent chromium at 95 mass % or more of chromium component contained at least on a surface of said metal member by immersing said metal member into a chromating bath; and conducting the heat treatment of said chromate coat at temperatures from 85 to 255° C., wherein said chromating bath is applied in the condition where the bath temperature is adjusted in a temperature range from 20 to 80° C.

3. A method for manufacturing a metal member with chromate coat comprising:

forming a chromate coat having a film thickness of 0.2 to 0.5 μm and composed of trivalent chromium at 95 mass % or more of chromium component contained at least on a surface of said metal member by immersing said metal member into a chromating bath; and conducting the heat treatment of said chromate coat at temperatures from 85 to 255° C., wherein an immersing time in said chromating bath is from 20 to 80 seconds.

4. A method for manufacturing a metal member with chromate coat comprising:

forming a chromate coat having a film thickness of 0.2 to 0.5 μm and composed of trivalent chromium at 95 mass % or more of chromium component contained at least on a surface of said metal member by immersing said metal member into a chromating bath; and conducting the heat treatment of said chromate coat at temperatures from 85 to 255° C., wherein said heat treatment step is performed in a condition satisfying any one of the following conditions, $30 \leqq t \leqq 1800$ for $85 \leqq T \leqq 155$ $30 \leqq t \leqq 1500$ for $155 \leqq T < 170$ $30 \leqq t \leqq 1200$ for $170 \leqq T < 190$ $30 \leqq t \leqq 900$ for $190 \leqq T < 205$ $30 \leqq t \leqq 600$ for $205 \leqq T < 215$ $30 \leqq t \leqq 480$ for $215 \leqq T < 230$ $30 \leqq t \leqq 300$ for $230 \leqq T < 245$ $30 \leqq t \leqq 240$ for $245 \leqq T < 255$ where the heat treatment temperature is T (° C.) and the heat treatment time is t (sec).

5. A method for manufacturing a metal member with chromate coat comprising:

forming a chromate coat having a film thickness of 0.2 to 0.5 μm and composed of trivalent chromium at 95 mass % or more of chromium component contained at least on a surface of said metal member by immersing said metal member into a chromating bath; and conducting the heat treatment of said chromate coat at temperatures from 85 to 255° C., wherein said heat treatment step is performed in a condition satisfying any one of the following conditions, $210 \leqq t \leqq 1800$ for $85 \leqq T \leqq 95$ $90 \leqq t \leqq 1800$ for $95 < T \leqq 110$ $45 \leqq t \leqq 1800$ for $110 < T \leqq 130$ $30 \leqq t \leqq 1800$ for $130 \leqq T < 145$ $30 \leqq t \leqq 1500$ for $145 \leqq T < 155$ $30 \leqq t \leqq 1200$ for $155 \leqq T < 170$ $30 \leqq t \leqq 900$ for $170 \leqq T < 190$ $30 \leqq t \leqq 600$ for $190 \leqq T < 205$ $30 \leqq t \leqq 480$ for $205 \leqq T < 215$ $30 \leqq t \leqq 300$ for $215 \leqq T < 230$ $30 \leqq t \leqq 240$ for $230 \leqq T < 245$ $30 \leqq t \leqq 180$ for $245 \leqq T < 255$ where the heat treatment temperature is T (° C.) and the heat treatment time is t (sec).

6. A method for manufacturing a metal member with chromate coat comprising:

forming a chromate coat having a film thickness of 0.2 to 0.5 μm and composed of trivalent chromium at 95 mass % or more of chromium component contained at least on a surface of said metal member by immersing said metal member into a chromating bath; and conducting the heat treatment of said chromate coat at temperatures from 85 to 255° C., wherein said heat treatment step is performed in a condition satisfying the following inequality, $$30 \leqq t \leqq 0.094 \times \exp(4201/T)$$

where the heat treatment temperature is T (K) and the heat treatment time is t (sec).

7. A metal member comprising:

a sliding expected surface expected to slide or having already slid with another member and;

a chromate coat composed of trivalent chromium at 95 mass % or more of chromium component and having a film thickness of 0.2 to 0.5 μm on at least said sliding expected surface, and the hardness of said sliding expected surface with said chromate coat is in a range from 1500 to 3000N/mm$^2$, in universal hardness (HU), measured under a pressing load of 40 mN for an indenter in accordance with a method as defined in the German standards DIN50359-1.

8. A spark plug comprising said metal member according to claim 7, wherein said metal member is caulked against an outside of an insulator provided in the spark plug, said sliding expected surface is an outside surface of a caulking portion of said metal member.

* * * * *